US010478025B2

(12) United States Patent
Dunn et al.

(10) Patent No.: US 10,478,025 B2
(45) Date of Patent: Nov. 19, 2019

(54) TOILET TRAINING DEVICES FOR SMALL CHILDREN

(75) Inventors: Steven B. Dunn, Beverly Hills, CA (US); Mark A. Hatherill, Beverly Hills, CA (US); Mark G. Tebbe, Ventura, CA (US); Huisok Pyon, Paramount, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 12/901,464

(22) Filed: Oct. 8, 2010

(65) Prior Publication Data

US 2012/0084907 A1 Apr. 12, 2012

(51) Int. Cl.
*A47K 11/06* (2006.01)
*E03D 9/00* (2006.01)

(52) U.S. Cl.
CPC ..... *A47K 11/06* (2013.01); *E03D 9/007* (2013.01)

(58) Field of Classification Search
CPC ..... A47K 11/06; E03D 9/007
USPC ..... 4/229, 230, 476–479; 220/694, 908.2; 239/34–60
See application file for complete search history.

(56) References Cited

U.S. PATENT DOCUMENTS 1,656,015 A * 1/1928 Radcliffe ..... 220/87.1
2,147,139 A * 2/1939 Bigman et al. ..... 220/87.1
3,214,065 A * 10/1965 Coward Thornton .... B65F 7/00 222/166
3,579,663 A * 5/1971 Leiter et al. ..... 4/230
3,609,775 A * 10/1971 Leiter et al. ..... 4/230
4,633,536 A 1/1987 Tribble-DuBose
5,720,432 A * 2/1998 Gaskin ..... A61L 9/12 239/36
5,765,236 A 6/1998 Bethanis
(Continued)

FOREIGN PATENT DOCUMENTS

JP 2002-051938 A 2/2002
JP 3134078 U 7/2007
WO 95/27430 10/1995

OTHER PUBLICATIONS

Internation Search Report and Written Opinion of the ISA for PCT/US2011/055232, dated Apr. 19, 2012, (10 Pages).
(Continued)

*Primary Examiner* — Alexander M Valvis
*Assistant Examiner* — Qingzhang Zhou
(74) *Attorney, Agent, or Firm* — Robert Z. Evora, Esq.

(57) ABSTRACT

A toilet training device includes an odor remediation system for absorbing or masking odors that may be created during toilet training. The odor remediation system may include a modular odor remediating insert that may be releasably positioned within a recess that is provided within the toilet training device. The odor remediating insert may include an odor absorbing substance such as sodium bicarbonate, an odor masking substance such as a fragrance or a combination of an odor absorbing substance and an odor masking substance. The toilet training device also includes a system for dispensing wipes that may utilize a recess that is defined in a side wall of the main body portion of the toilet training device. A wipes cartridge is designed so that it can be used to conveniently dispense wipes regardless of whether it is separated from the toilet training device or mounted within the recess of the toilet training device.

17 Claims, 15 Drawing Sheets

(56) References Cited

U.S. PATENT DOCUMENTS

| | | | | |
|---|---|---|---|---|
| 5,781,939 | A | 7/1998 | Bledsoe | |
| 5,978,976 | A | 11/1999 | Chai | |
| 6,067,666 | A | 5/2000 | Dixon | |
| 6,895,604 | B1 * | 5/2005 | Ramsey | 4/213 |
| 7,086,569 | B2 * | 8/2006 | Stravitz | B65F 7/00 220/908 |
| 7,490,733 | B2 | 2/2009 | Tagliareni | |
| 7,631,370 | B2 | 12/2009 | Dunn et al. | |
| 7,696,711 | B2 * | 4/2010 | Pollack | B65F 1/06 318/466 |
| 2004/0199986 | A1 | 10/2004 | Bernsley | |
| 2004/0238656 | A1 * | 12/2004 | Wang | 239/34 |
| 2006/0162301 | A1 * | 7/2006 | Safuto | 55/385.1 |
| 2007/0017015 | A1 * | 1/2007 | Finell | A47K 11/06 4/483 |
| 2007/0125792 | A1 * | 6/2007 | Pollack et al. | 220/908.2 |
| 2010/0224627 | A1 * | 9/2010 | Yang et al. | 220/212 |

OTHER PUBLICATIONS

Thompson Innovation, Record Innovation Record View for JP2002051938A, Apr. 11, 2013, (5 Pages).

* cited by examiner

TOILET TRAINING DEVICES FOR SMALL CHILDREN

BACKGROUND OF THE INVENTION

1. Field of the Invention

The invention relates to the field of children's educational and development devices. In particular the invention relates to toilet training devices for children. Certain aspects of the invention also have applicability for use in adult toilet seats.

2. Description of the Related Technology

One of the milestones that a child passes when growing older is becoming potty trained. Part of the process of potty training is learning how to use adult bathroom facilities. In order to assist a child in the learning process, a number of products have been developed to help encourage and assist a child in using adult toilet and other bathroom facilities. The assignee of this invention, Munchkin, Inc. has developed and sold a number of such products, one of which is described in U.S. Pat. No. 7,631,370 to Dunn et al.

Some types of toilet training devices are designed to be placed directly upon either the rim or seat of an adult toilet. Other types of such devices resemble a miniature adult toilet and have a collection chamber, sometimes having a collection bag or liner, defined therein for holding urine, feces and wipes.

When acclimating a small child to the use of an adult toilet or potty seat, it is desirable to place both the child and the caregiver at ease to the extent possible, and to make the child as comfortable as possible. A child who is transitioning away from diapers is often used to being wiped and cleaned with moist wipes. Toilet paper may feel uncomfortable for such a child, and this could potentially erode the child's enthusiasm for the toilet training process. A caregiver, however, may forget to pack wipes when traveling with a potty seat. Even in the home, packages of wipes may be misplaced. In addition, it is often difficult to position a package of wipes within easy reach of the child or the caregiver during toilet training. Accordingly, a toilet training device that would make it easier for a child or caregiver to conveniently access wipes while the child is on the potty seat would represent an improvement over conventional toilet training devices.

U.S. Pat. No. 7,779,489 to Finell discloses a step stool potty bench that has a plurality of storage areas that may be used for containing materials such as wipes, toilet paper or baby powder. However, this is not a practical solution for storing individual wipes, because they will lose their moistness within a short period of time. In addition, the storage compartments that are provided in the Finell potty bench are not of the proper size and shape to receive an entire container of wipes. Even if a container of wipes happened to have a size and shape permitting it to fit within one of the compartments, the dispensing opening would not necessarily be easily accessible to the child or the caregiver.

Odors can also be a concern during toilet training. Toilet training seats that have storage compartments for urine and feces can be a significant source of odor, particularly in instances when they are not immediately and feet and cleaned by the caregiver. To the extent that odors can be minimized by absorption or masking, the toilet training process can be made more enjoyable for both the child and the caregiver. There are a number of examples of deodorizing systems for use with adult toilets, but these would not necessarily be appropriate for use with a toilet training system. A plethora of household devices for masking or absorbing odors also exist, but many of them are not readily transportable when traveling or safe to be within the reach of a small child.

A need exists for an improved toilet training device that provides convenient access to moist wipes for the child and the caregiver. A need also exists for an improved toilet training device that helps control odors in a manner that is convenient and safe for a small child.

SUMMARY OF THE INVENTION

Accordingly, it is an object of the invention to provide an improved toilet training device that provides convenient access to moist wipes for both the child and the caregiver.

It is further an object of the invention to provide an improved toilet training device that helps control odors in a manner that is convenient and safe for a small child.

In order to achieve the above and other objects of the invention, a toilet seat lid according to a first aspect of the invention includes a main body portion and a recess that is defined in the main body portion. It also includes an odor remediating insert that is releasably engaged within the recess.

A toilet training device according to a second aspect of the invention includes a seat assembly; a main body portion; and a recess defined in at least one of the seat assembly and main body portion for releasably receiving an odor remediating insert.

A toilet training device according to a third aspect of the invention includes a main body portion; a lid having an underside; and an odor remediating insert releasably attached to the underside of the lid. The odor remediating insert is mounted to the underside of the lid so that it does not substantially protrude from the underside of the lid.

A toilet training device according to a fourth aspect of the invention includes a main body portion; a seat assembly; and an odor remediating insert.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
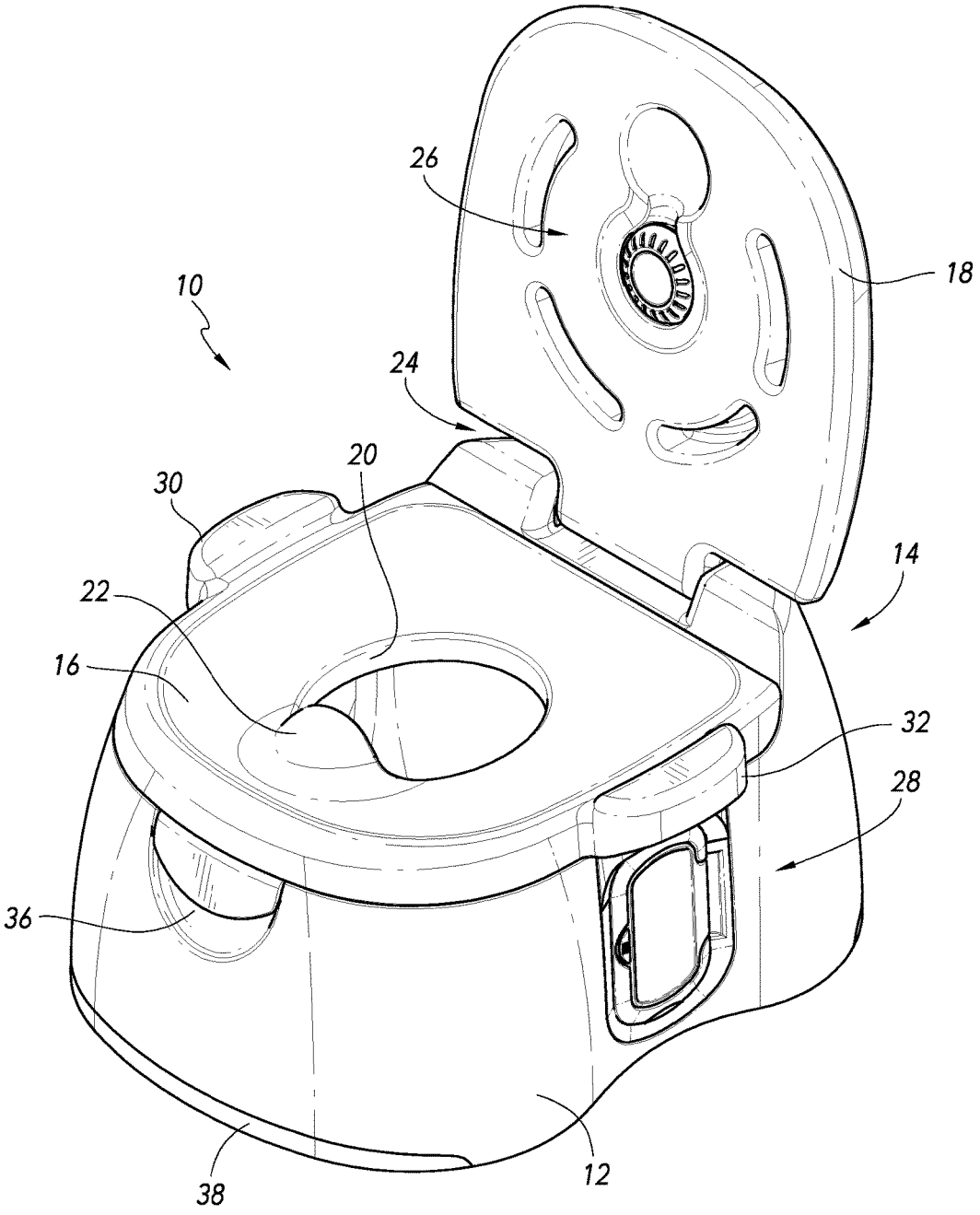
FIG. 1 is a perspective view of a toilet training device according to a first embodiment of the invention, shown in a first operative position.

Referring now to the drawings, wherein like reference numerals designate corresponding structure throughout the views, and referring in particular to FIG. 1, a toilet training device 10 that is constructed according to a first, preferred embodiment of the invention includes a main body portion 12 and a seat assembly 14 having a removable seat 16 and a movable lid 18. A removable waste pan 17 is mounted within an interior space that is defined within the main body portion 12.

The removable seat 16 has a central opening 20 defined therein, as is typical for a toilet seat or a toilet training device. A deflector 22 is preferably integrally molded into the removable seat 16 at a forward portion thereof for deflecting urine downwardly into the removable waste bin 17 that is removably positioned within the main body portion 12, best shown in FIG. 5.

Figure 2:
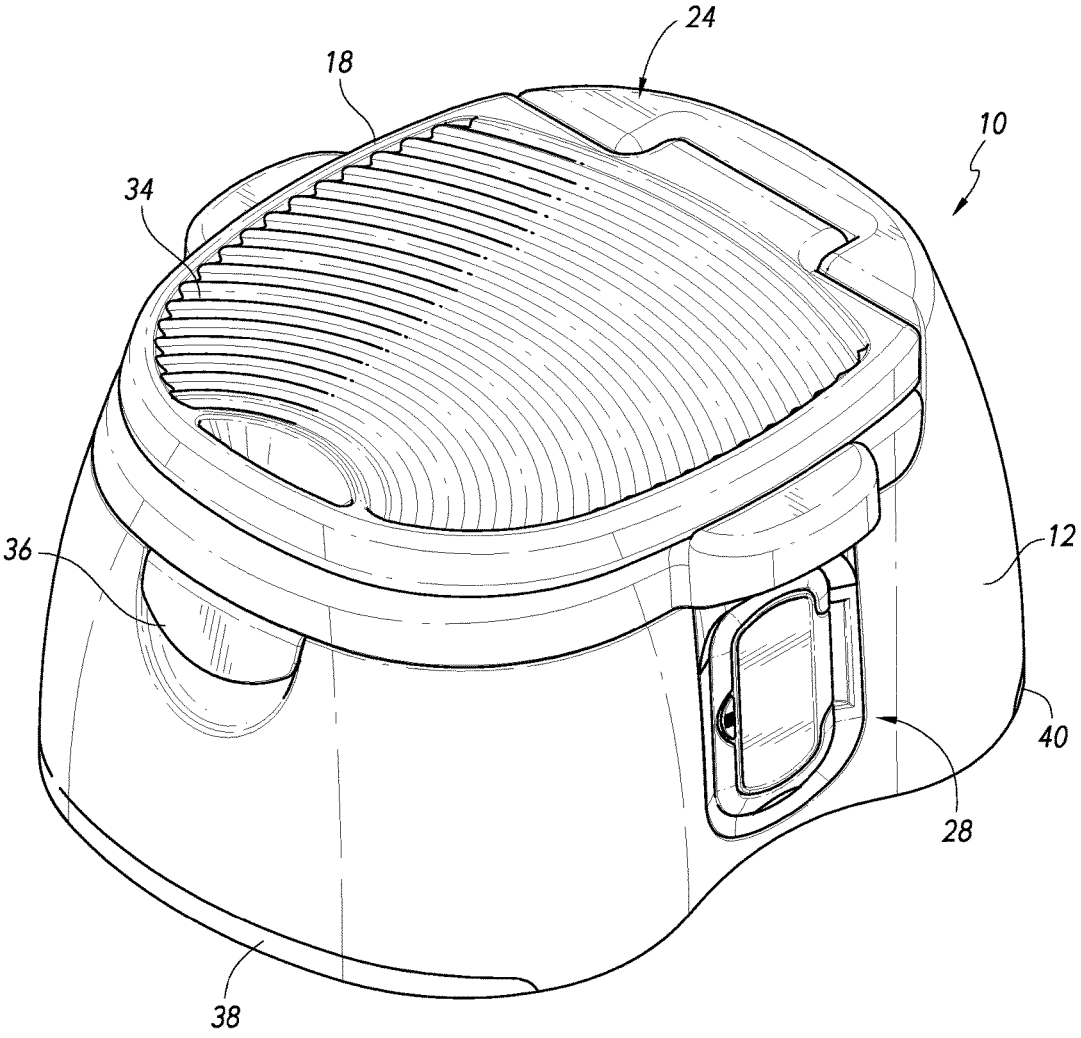
FIG. 2 is a perspective view of the toilet training device shown in FIG. 1, shown in a second operative position.

Lid 18 is preferably pivotally mounted to the main body portion 12 by a hinge assembly 24, which guides the lid 18 between the open position shown in FIG. 1 and the closed position that is shown in FIG. 2. An odor remediation system 26 is advantageously provided within the toilet training device 10, preferably as part of the seat assembly 14. In the illustrated preferred embodiment, the odor remediation system 26, which will be discussed in greater detail below, is provided within an underside of the movable lid 18. The odor remediation system 26 is preferably non-dispensing, meaning that it does not dispense any significant amount of powder or liquid into the toilet training device 10.

Figure 3:
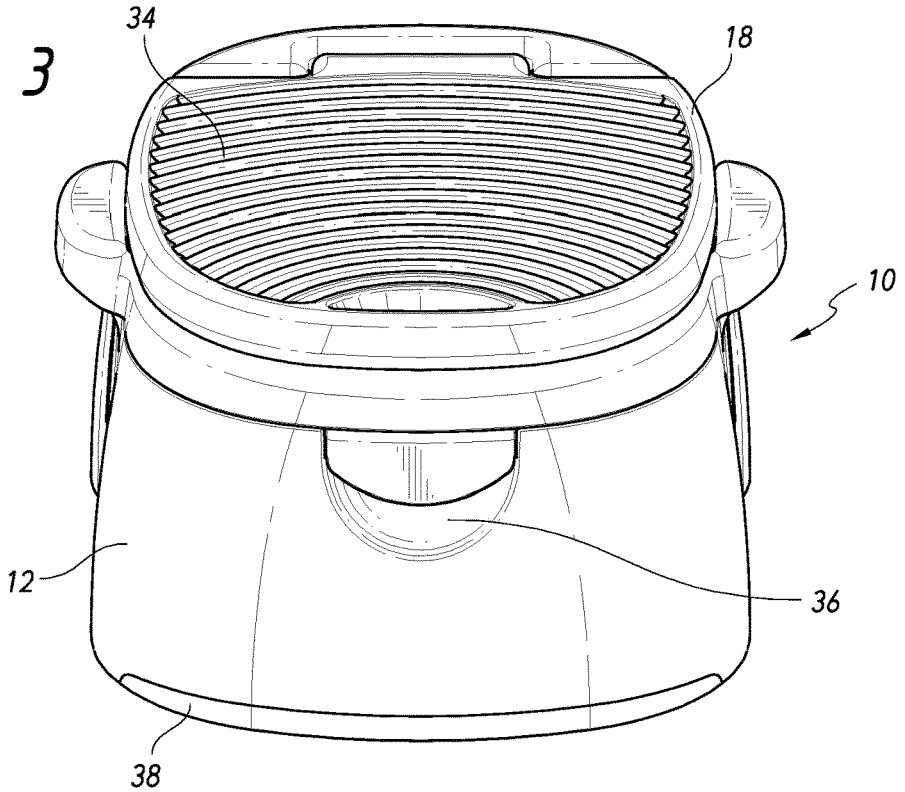
FIG. 3 is a front perspective view of the toilet training device shown in FIG. 2.
Figure 4:
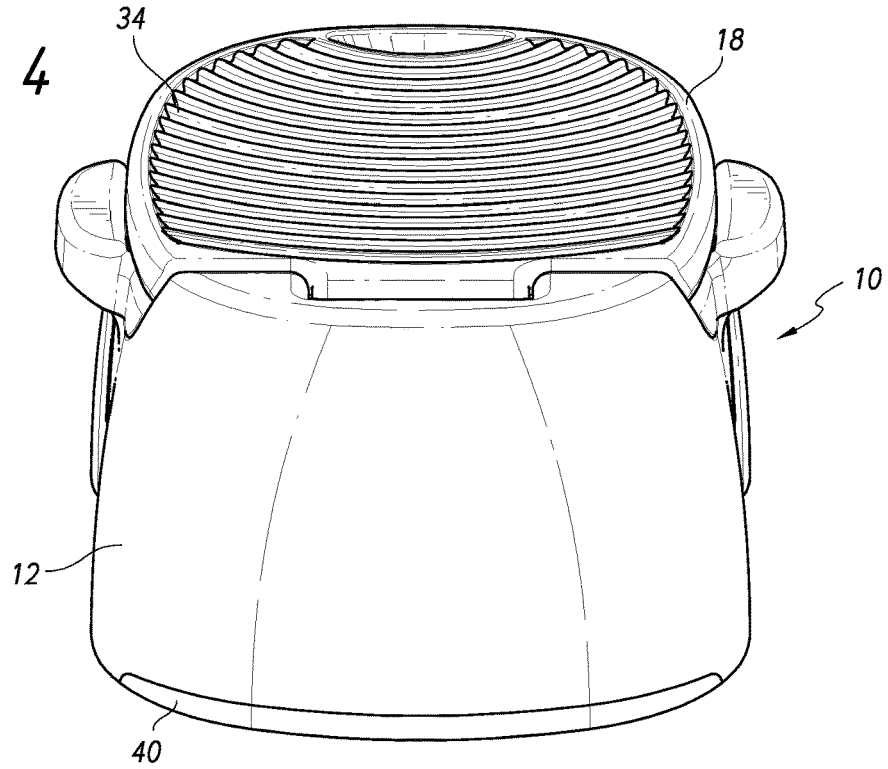
FIG. 4 is a rear perspective view of the toilet training device shown in FIG. 2.

Lid 18 is also preferably constructed to be of sufficient strength so that the toilet training device 10 can be used as a step stool by a small child during toilet training or for other activities. As is best shown in FIGS. 2-4, an upper surface of the lid 18 is provided with a plurality of reinforcing ribs 34, which both reinforce the structural strength of the lid 18 and provide a nonslip surface for the child's feet when the toilet training device 10 is being used as a step stool.

Preferably, lid 18 is constructed to be of sufficient strength to support a top load weight that is substantially within a range of about 20 pounds to about 200 pounds. More preferably, lid 18 is constructed to be of sufficient strength to support a top load weight that is at substantially within a range of about 30 pounds to about 180 pounds. Most preferably, lid 18 is constructed to be of sufficient strength to support a top load weight that is substantially within a range of about 45 pounds to about 120 pounds.

The toilet training device 10 also preferably includes a wipes dispensing system 28 for dispensing wipes during use of the toilet training device 10. The wipes dispensing system 28 will be discussed in greater detail below.

The removable seat 16 is preferably fabricated from a plastic material such as polypropylene or polyethylene, and preferably includes a pair of handles 30, 32 that can be used by a small child during potty training or for a child or caregiver to remove the seat 16 from the main body portion 12. Removable seat 16 is also advantageously constructed so that it may be removed and placed directly on an adult toilet seat or a rim of an adult toilet for potty training.

The main body portion 12 of the toilet training device 10 is preferably provided with an integral handle 36 that is integral with the waste pan 17 for permitting a consumer to easily grasp and remove the waste pan 17 from the remainder of the main body portion 12 after the seat 16 has been removed from the main body portion 12.

In addition, at least one elastomeric support foot is preferably provided on a lower surface of the main body portion 12 for reducing the potential for slippage of the toilet training device 10 with respect to an underlying surface such as a tile floor during use. This is particularly important when the toilet training device 10 is being used as a step stool by a small child. In the preferred embodiment, the main body portion 12 is provided with a first elastomeric support foot 38 that is located at a frontal bottom portion of the main body portion 12, and a second elastomeric support foot 40 that is located at a rear bottom portion of the main body portion 12. The support feet 38, 40 are preferably fabricated from a resilient, high friction elastomeric material such as thermoplastic elastomer (TPE) or polyvinyl chloride (PVC).

Figure 5:
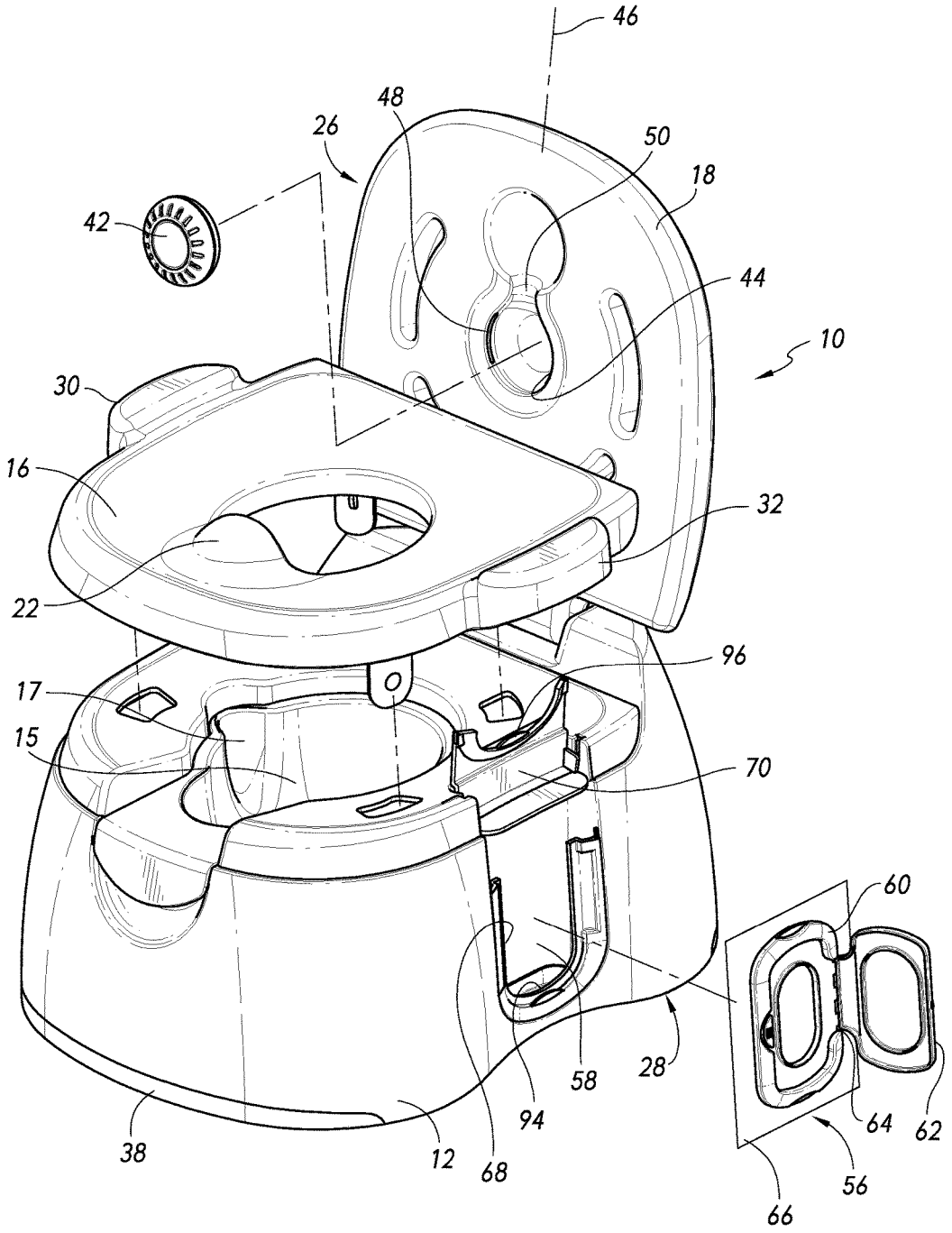
FIG. 5 is an exploded view of the toilet training device shown in FIG. 1.
Figure 11:
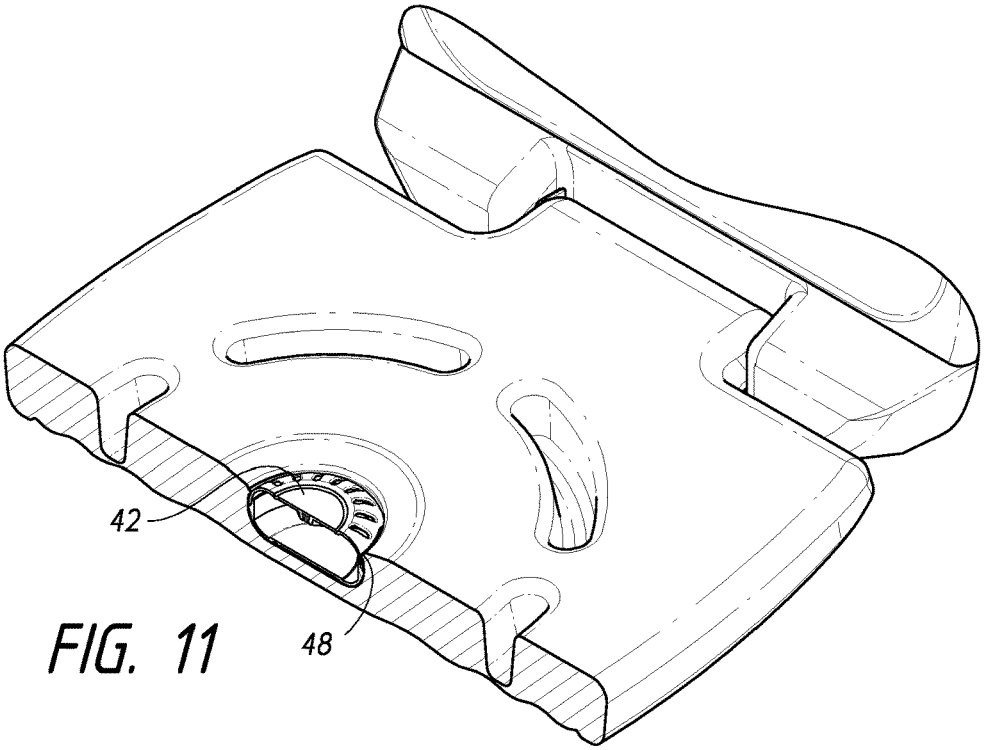
FIG. 11 is a cross-sectional fragmentary diagrammatical depiction of a portion of the toilet training device shown in FIG. 1.

Referring now briefly to FIG. 5, the odor remediation system 26 preferably includes at least one odor remediating insert 42 that is constructed and arranged to be releasably positioned within a recess 44 that is defined in a lower surface of the lid 18. The odor remediating insert 42 is constructed to be releasably retained within the recess 44 by means of an interference fit that is created between the circumferential outer surface of the odor remediating insert 42 and the inner surfaces of the recess 44. As is best shown in FIG. 11, a pair of locking ribs 48 is preferably integrally molded into the surfaces of the lid 18 defining the recess 44 in order to lock the odor remediating insert 42 into the underside of the lid 18.

A finger access opening 50 is preferably defined in the lower surface of the lid 18 in communication with the recess 44 for permitting a consumer to use his or her finger in order to pry the odor remediating insert 42 out of the recess 44.

Figure 6:
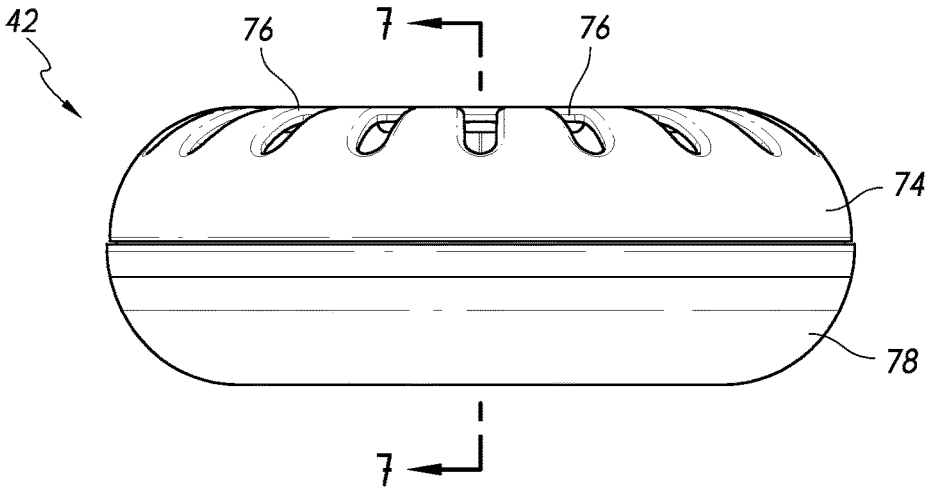
FIG. 6 is a side elevational view of an odor remediating insert used in the toilet training device shown in FIG. 1.

In the preferred embodiment, the odor remediating insert 42 is substantially round or circular in shape as viewed in front and rear elevation and oblong in shape as viewed in side elevation, as a shown in FIG. 6. In other words, it has a puck-like or disc-like shape.

Figure 7:
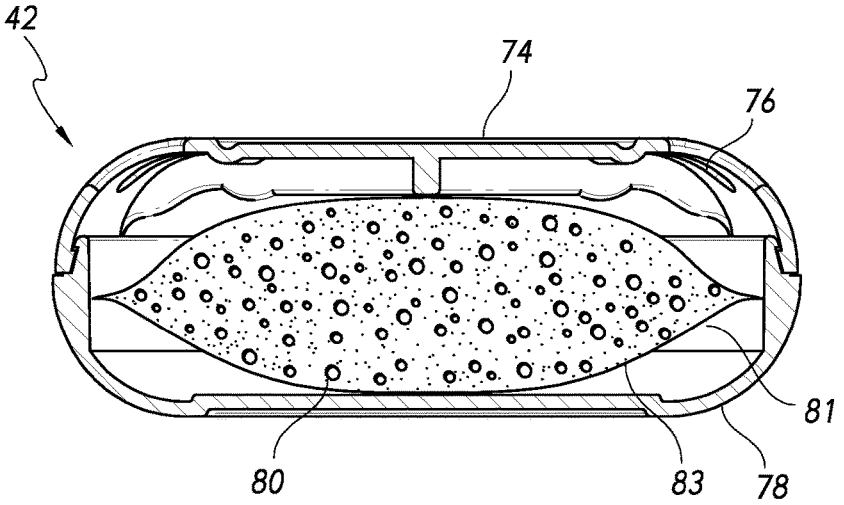
FIG. 7 is a fragmentary cross-sectional view taken along lines 7-7 in FIG. 6.

As FIGS. 6 and 7 show, the odor remediating insert 42 includes an upper portion 74 that has a plurality of ventilation slots or holes 76 defined therein, and a lower portion 78 that is secured to the upper portion 74 in a clamshell type assembly. An odor remediating substance 80 is provided within an interior space 81 that is defined by the interior surfaces of the upper and lower portions 74, 78. The odor remediating substance 80 preferably includes an odor absorbing substance such as sodium bicarbonate, also known as baking soda. Alternatively, the odor remediating substance 80 may include an odor masking substance such as a substance that emits a fragrance. The outer remediating substance 80 could also include both an odor absorbing substance and an odor masking substance, either as a mixture of the two substances or the positioning of two separate substances within the interior space 81 of the odor remediating insert 42.

In the most preferred embodiment, the odor remediating insert 42 includes a porous pouch 83, preferably fabricated from polyester, which contains a powdered air freshener composition. The air freshener composition includes sodium bicarbonate, a fragrance composition and SIPERNET 22, a carrier for the fragrance composition, which is commercially available from Insilco.

Referring again to FIG. 5, the recess 44 is preferably located substantially along a longitudinal axis 46 of the lid 18, which is coincident with the longitudinal axis of the toilet training assembly 10 when the lid 18 is in the closed position shown in FIG. 2. The recess 44 is also preferably substantially centered with respect to the underside of the lid 18. Because it is positioned on the underside of the lid 18, the recess 44 and the odor remediation insert 42 are positioned in communication with the interior of the main body portion 12, including the waste pan 17, when the lid 18 of the toilet training device 10 is closed. This maximizes the efficacy of the odor remediation system 26.

Figure 8:
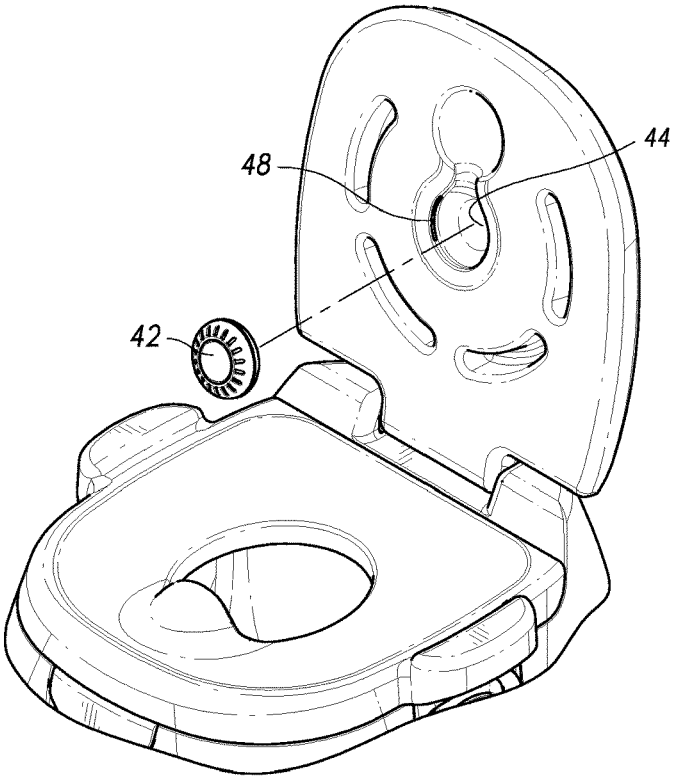
FIG. 8 is a first diagrammatical depiction of a first process of using the toilet training device shown in FIG. 1.
Figure 9:
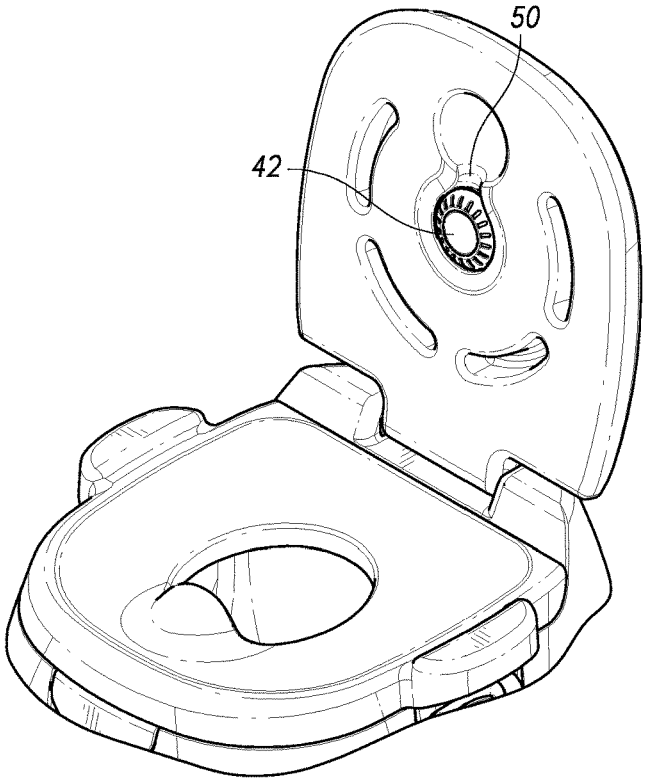
FIG. 9 is a second diagrammatical depiction of the first process of using the toilet training device shown in FIG. 1.
Figure 10:
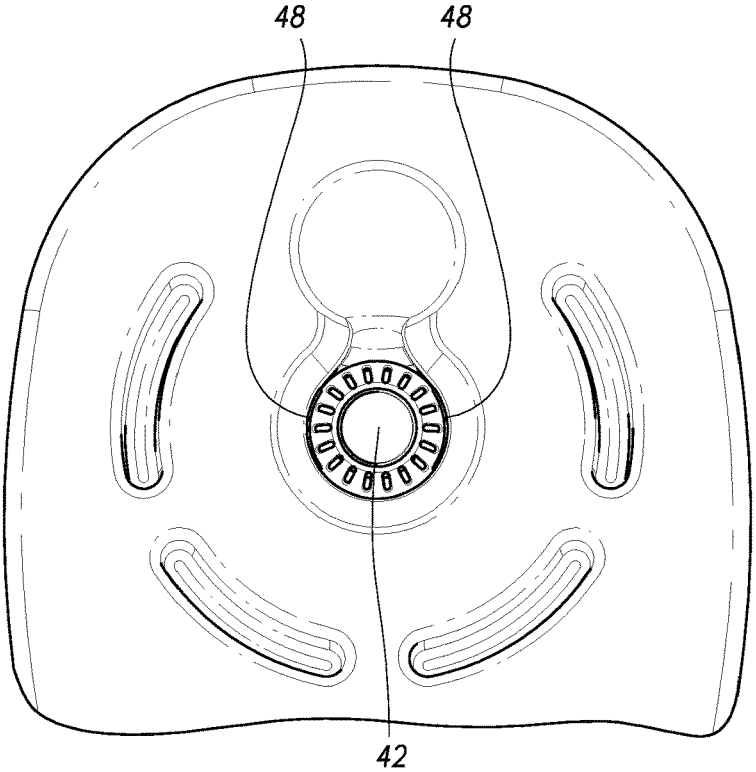
FIG. 10 is a third diagrammatical depiction of the first process of using the toilet training device shown in FIG. 1.

FIGS. 8-11 depict a method of installing an odor remediating insert 42 into a toilet training device 10 according to a preferred embodiment of the invention. As FIG. 8 shows, a consumer will grasp the odor remediating insert 42 and press it into the recess 44 until it is locked into place by an interference fit caused by the elastic deformation of the raised ribs 48. As shown in FIG. 9, the odor remediating insert will remain secured to the lid 18 as the toilet training device is used by a small child, providing odor remediation by absorbing or masking odor, or both.

At some point in time, when the odor absorbing or masking substance 80 within the interior space 81 of the odor remediating insert 42 loses its effectiveness, the consumer will use his or her finger to pry the odor remediating insert 42 out of the recess 44, thus overcoming the interference fit that exists between the outer circumferential surface of the odor remediating insert 42 and the raised ribs 48. The consumer may obtain a replacement odor remediating insert 42 as a separate article of purchase from a retailer. Alternatively, the odor remediating insert 42 could be fabricated so that it is openable by a consumer, and replacement odor remediating pouches could be made available for purchase by the consumer.

The modular nature of the odor remediating insert 42 accordingly permits odor remediation within the toilet training device 10 to be continued indefinitely without needing to replace the entire toilet training device 10.

The wipes dispensing system 28 preferably includes a wipes cartridge 56 having a substantially rigid frame 60, which is preferably fabricated from a plastic material such as polyethylene or polypropylene. A substantially rigid frame 60 is preferably attached to a flexible bag or container 66 that is fabricated from a waterproof or moisture impermeable material so that it can hold a plurality of moist wipes without them losing their moistness.

Preferably, the flexible container 66 is constructed of a thickness that is sufficient to hold a plurality of wipes that is substantially within a range of about 10 wipes to about 120 wipes, more preferably substantially within a range of about 15 wipes to about 100 wipes, and most preferably within a range of about 20 wipes to about 80 wipes. The thickness of the flexible container 66 preferably a substantially within a range of about ⅜ of an inch to about 3 inches, more preferably substantially within a range of about 7/16 of an inch to about 2.5 inches and most preferably within a range of about ½" to about 2.0 inches.

Wipes cartridge 56 is preferably constructed so that it can be used as a stand-alone wipes dispenser when it is not positioned within the toilet training assembly 10, such as when a child and his or her caregiver are traveling.

Figure 17:
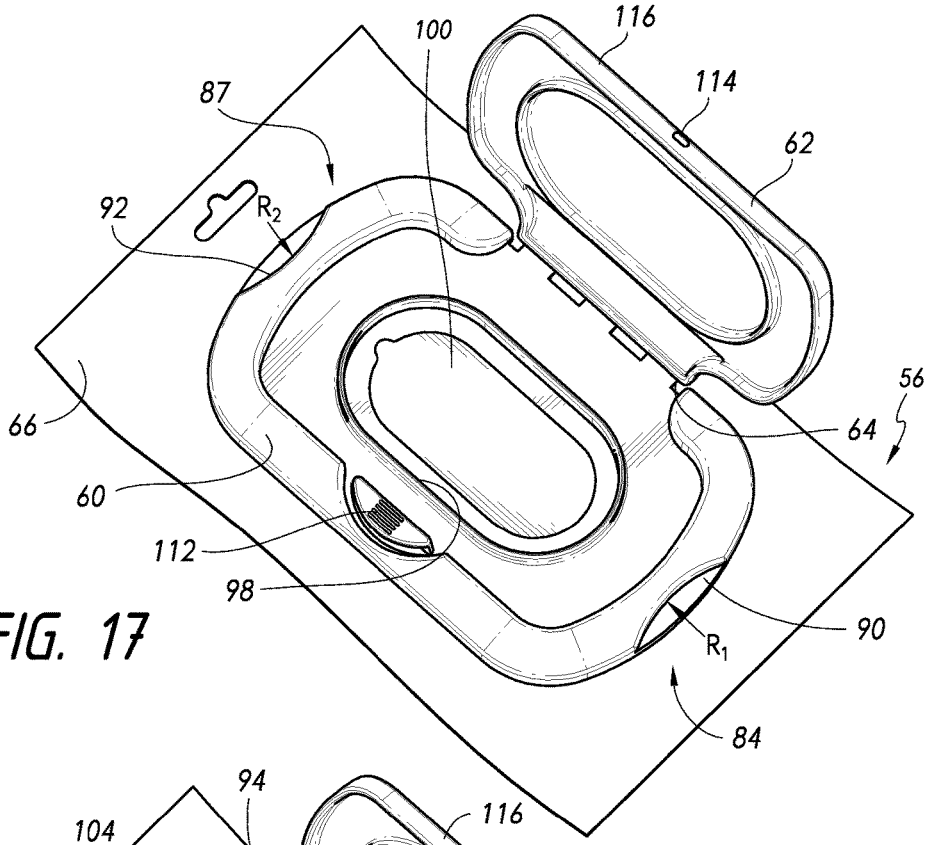
FIG. 17 is a perspective view of a wipes cartridge to be used with the toilet training device shown in FIG. 1.
Figure 18:
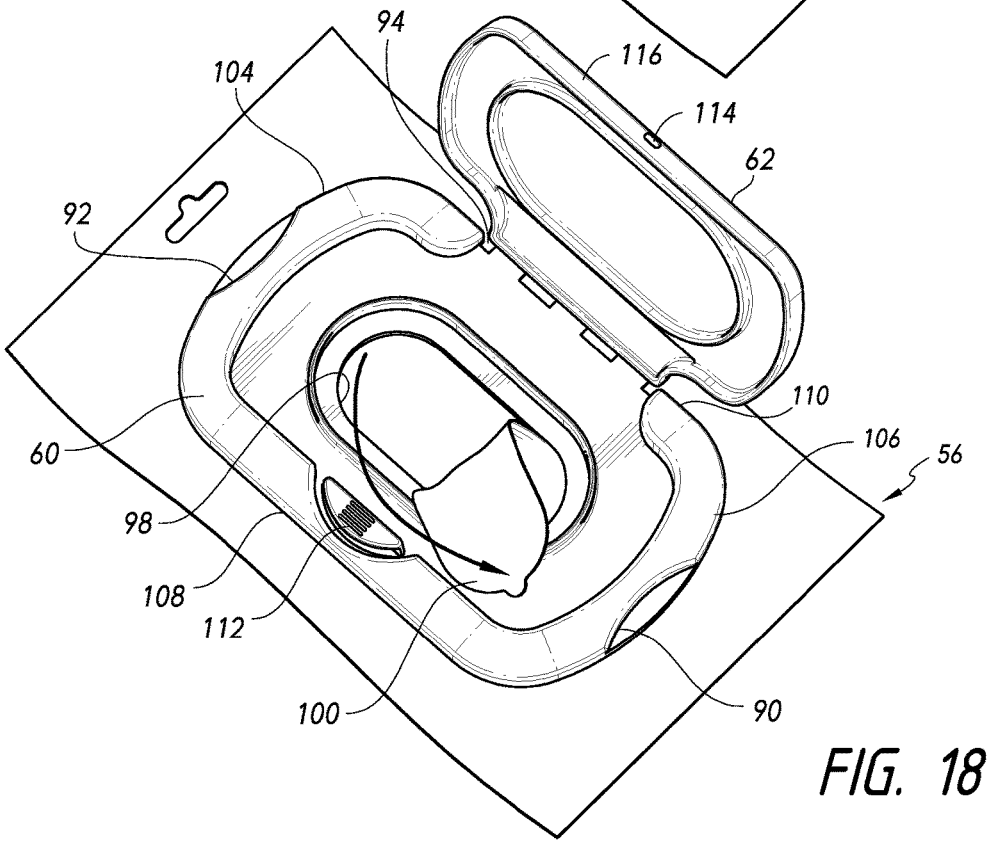
FIG. 18 is a diagrammatical depiction of one component of the wipes cartridge shown in FIG. 17 being removed by a consumer.

The substantially rigid frame 60 also preferably includes a lid 62 that is pivotally mounted to the remainder of the frame 60 by an integral hinge 64, as is best shown in FIGS. 5, 17 and 18. As FIGS. 17 and 18 show, the substantially rigid frame 60 defines a dispensing opening 98 through which a consumer may extract wipes from the wipes cartridge 56 when the lid 62 is in the open position. An adhesive cover 100 is preferably positioned to cover the dispensing opening 98 when the lid 62 is first opened by a consumer. As FIG. 18 shows, the adhesive cover 100 may be peeled back by a consumer in order to expose the dispensing opening 98. After withdrawing one or more wipes, the adhesive cover 100 may be returned to its original position in order to form a moisture barrier in order to prevent moisture loss from the wipes.

Figure 12:
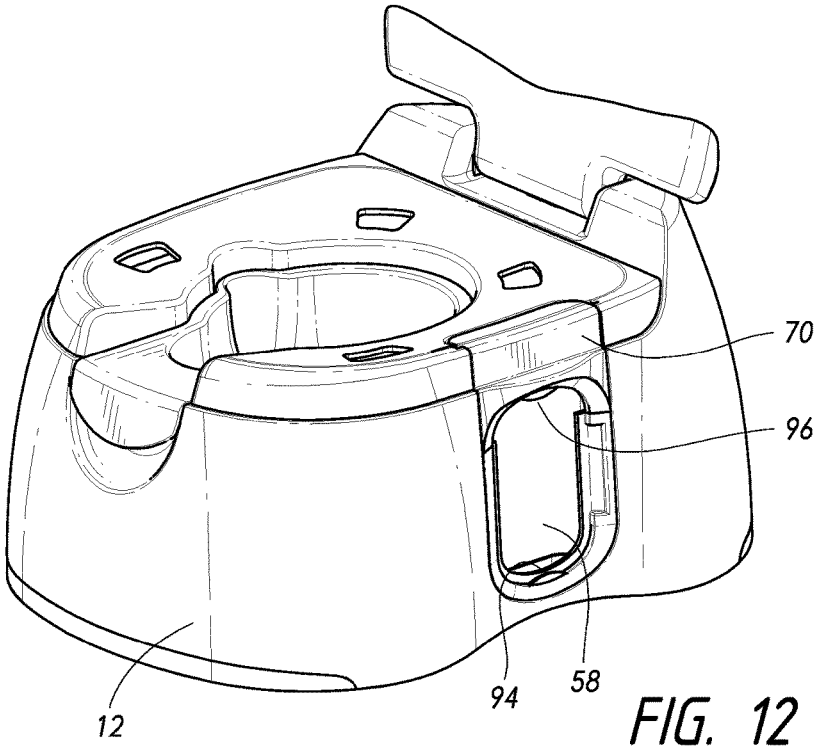
FIG. 12 is a first diagrammatical depiction of a second process of using the toilet training device shown in FIG. 1.

As FIG. 12 shows, the seat 16 must be removed in order to install or remove a wipes cartridge 56 into or out of the recess 58. After the seat 16 has been removed, a removable cover 70 that is hingedly mounted to the main body portion 12 is lifted upwardly by the consumer, exposing an upper portion of the recess 58. This is shown diagrammatically in FIG. 13. A wipes cartridge 56 may be installed into the recess 58 by aligning the rigid frame 60 of the cartridge 56 with the guide structure 68 that is defined in the main body portion 12 within the recess 58 and, as FIG. 14 shows, pressing the wipes cartridge 56 down so that it slides downwardly into the recess 58 while constrained against outward movement by the guide structure 68.

Alternatively, the removable cover 70 may be mounted to the main body portion 12 so that it may be completely removed from the main body portion 12. For example, it could be mounted for insertion and removal with respect to the main body portion 12 with a sliding motion.

Figure 13:
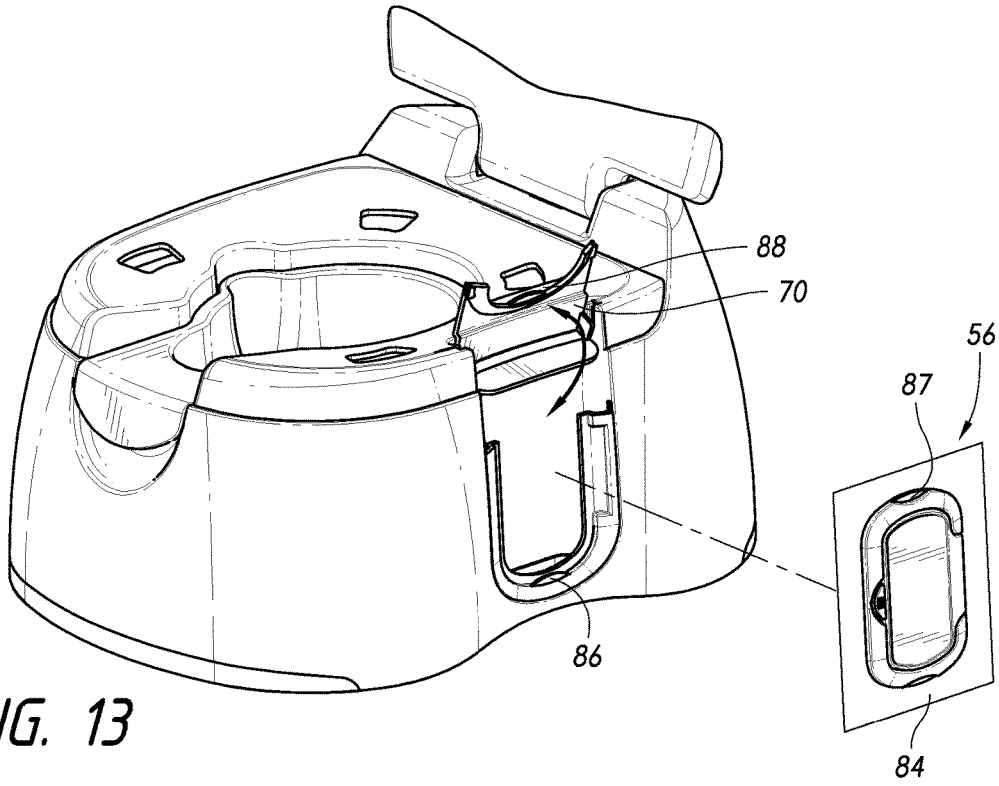
FIG. 13 is a second diagrammatical depiction of the second process of using the toilet training device.
Figure 14:
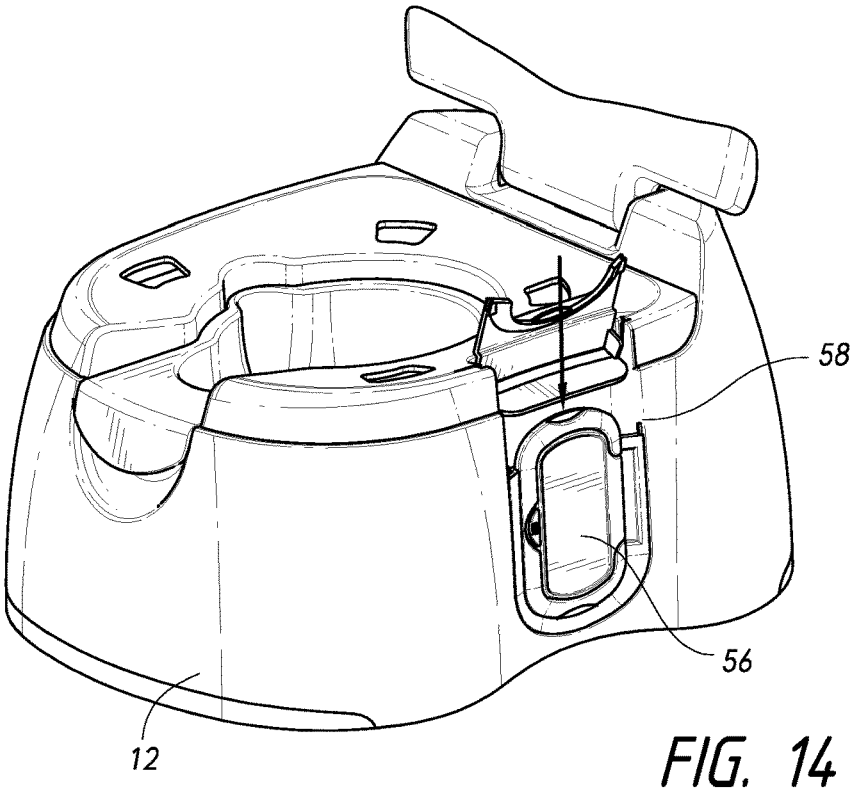
FIG. 14 is a third diagrammatical depiction of the second process of using the toilet training device.
Figure 15:
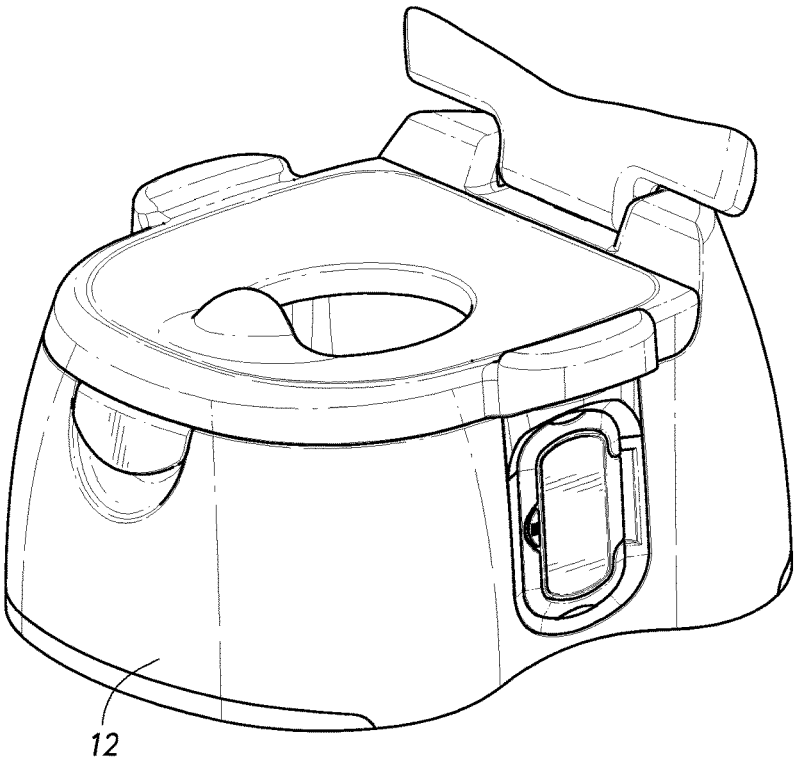
FIG. 15 is a fourth diagrammatical depiction of the second process of using the toilet training device.
Figure 16:
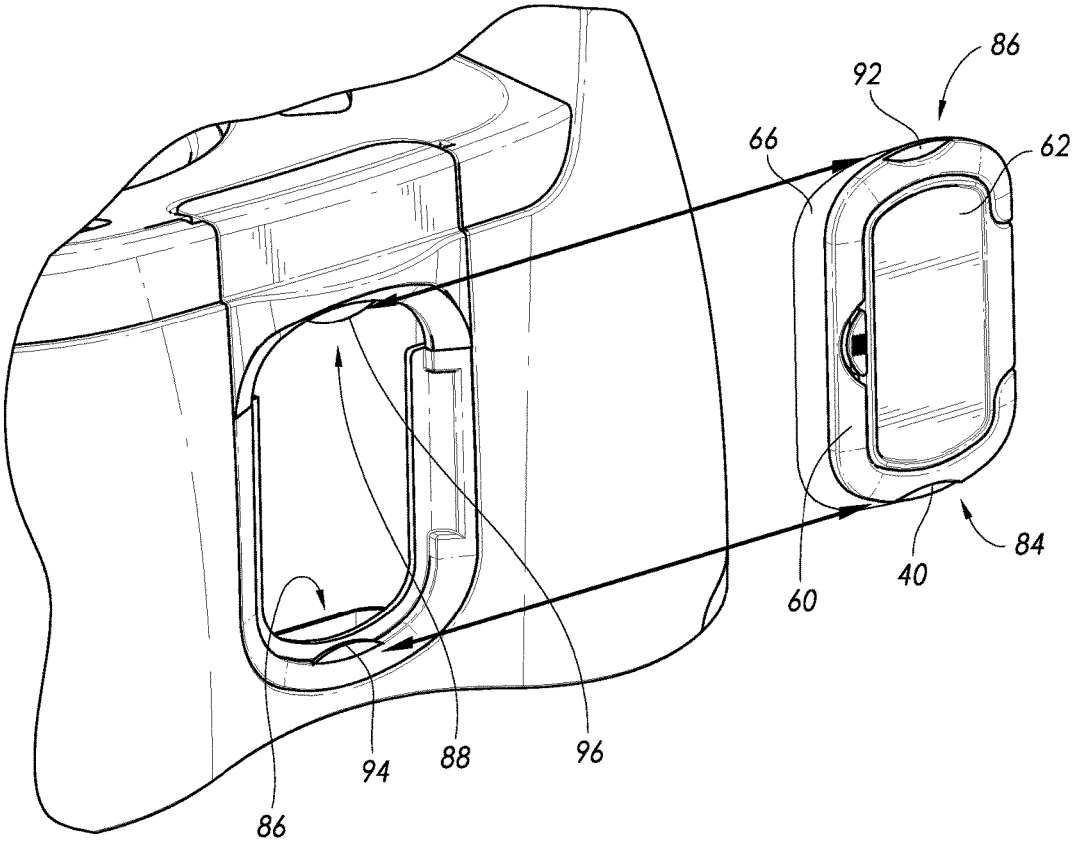
FIG. 16 is a fragmentary diagrammatical depiction showing the insertion of a wipes cartridge into the toilet training device shown in FIG. 1.

As FIGS. 13 and 16 best show, a lower portion of the substantially rigid frame 60 is preferably provided with a first alignment feature 84 that is complementary with a second alignment feature 86 that is defined in the main body portion 12 near the bottom of the recess 58. In addition, an upper portion of the substantially rigid frame 60 is preferably provided with a third alignment feature 87 that is complementary with a fourth alignment feature 88 that is defined on the movable cover 70. The first and second alignment features 84, 86 are constructed and arranged to fit snugly together and to align the frame 60 with respect to the recess 56, centering the frame 60 with respect to the recess 56. The third and fourth alignment features 87, 88 are constructed and arranged to fit snugly together and to align the frame 60 with respect to the movable cover 70.

In addition to aligning the wipes cartridge 56 with respect to the recess 58, the alignment features 84, 86, 87, 88 also function to help lock the wipes cartridge 56 into place with respect to the recess 58.

Referring to FIGS. 17 and 18, in the preferred embodiment the first alignment feature 84 is embodied as a first concave recess 90 that is preferably of substantially constant curvature and that preferably has an average radius of curvature that is substantially within the range of about 0.25 inch to about 10 inches, more preferably substantially within a range of about 0.4 inch to about 5 inches and most preferably substantially within a range of about 0.6 inch to about 2.0 inches.

The first concave recess 90 preferably has a maximum depth as measured from its outermost surface that is substantially within a range of about 0.025 inch to about 1.0 inch, more preferably substantially within a range of about 0.05 inch to about 0.5 inch and most preferably substantially within a range of about 0.10 inch to about 0.25 inch.

The third alignment feature 87 is preferably embodied as a second concave recess 92 that is preferably a substantially constant curvature and that preferably is substantially identical in size and shape to the first concave recess 90.

Referring to FIGS. 5 and 12, the second alignment feature 86 is preferably embodied as a first curved convex projection 94, which is preferably complementary in shape with the first concave recess 90. The fourth alignment feature 88 is also preferably embodied as a second curved convex projection 96, which is preferably complementary in shape with the second concave recess 92. Preferably, the first curved convex projection 94 is identical in size and shape to the second curved convex projection 96.

Accordingly, each of the first and second curved convex projections 94, 96 preferably has a substantially constant curvature and preferably has an average radius of curvature that is substantially within the range of about 0.25 inch to about 10 inches, more preferably substantially within a range of about 0.4 inch to about 5 inches and most preferably substantially within a range of about 0.6 inch to about 2.0 inches.

In addition, each of the first and second curved convex projections 94, 96 preferably has a maximum extent of projection from base to tip that is substantially within a range of about 0.025 inch to about 1.0 inch, more preferably substantially within a range of about 0.05 inch to about 0.5 inch and most preferably substantially within a range of about 0.10 inch to about 0.25 inch.

The wipes cartridge 56 further preferably includes a generally convex, rounded upper end 104 and a generally convex rounded lower end 106. It further includes a substantially flat first side surface 108 and a substantially flat second side surface 110. The lid 62 is preferably attached to the substantially flat second side surface 110 by means of an integral hinge 64. A side surface 116 of the lid 62 that is distal from the hinge 64 preferably includes a locking tab 114 that is releasably engageable by a latch 112 when the lid is in the closed position.

Figure 19:
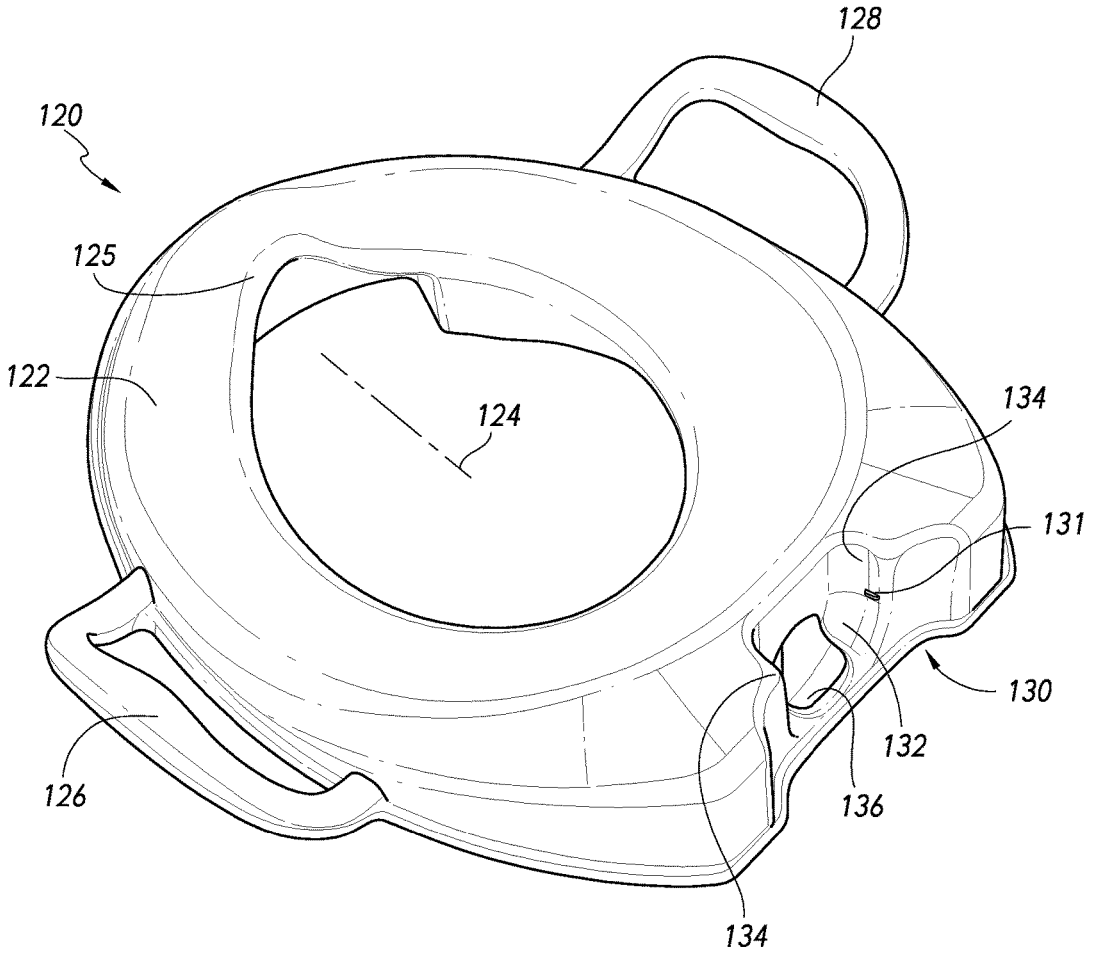
FIG. 19 is a perspective view of a toilet training device that is constructed according to a second embodiment of the invention.
Figure 20:
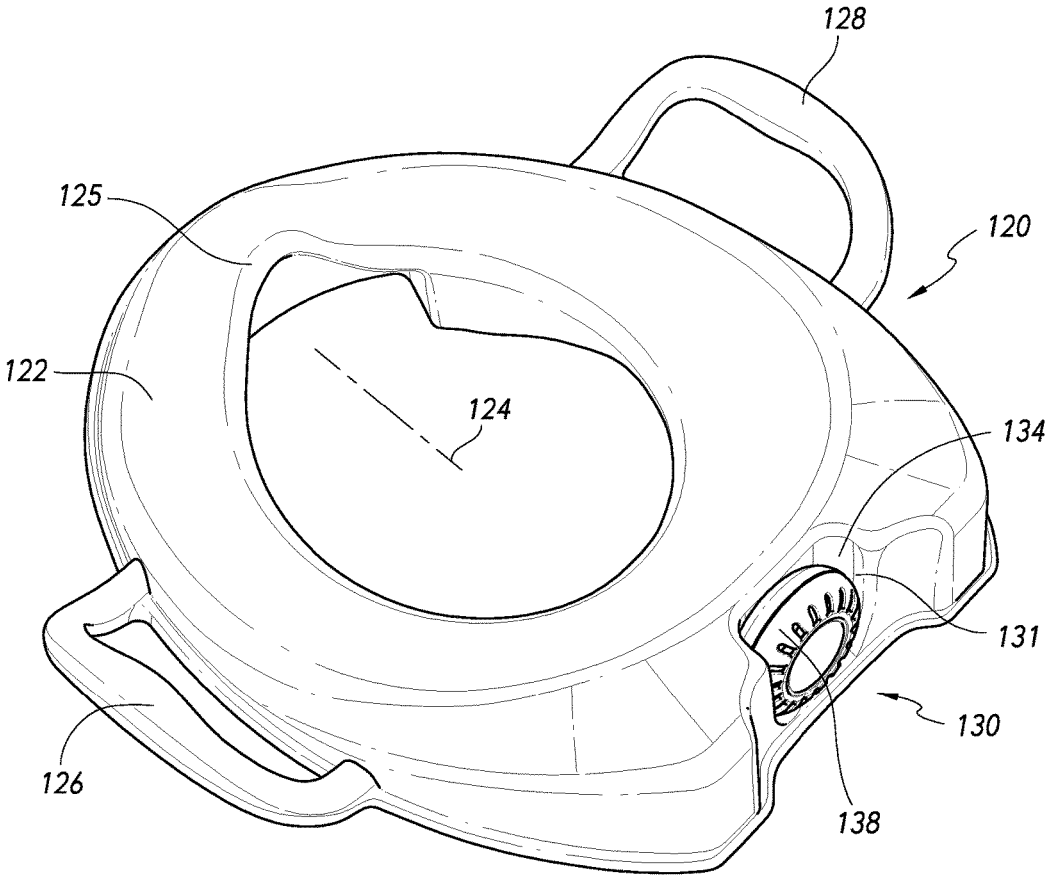
FIG. 20 is a perspective view of the toilet training device shown in FIG. 19, with an odor remediating insert positioned therein.

A toilet training device 120 that is constructed according to a second embodiment of the invention is depicted in FIGS. 19 and 20. Toilet training device 120 includes a seat 122 that defines a longitudinal axis 124, as is shown in FIG. 19. A deflection shield 125 is positioned at the front of the seat 22. A pair of handles 126, 128 is fixed to side surfaces of the seat 122.

Toilet training device 120 further includes an odor remediation system 130 that includes a recess 132 that is defined in a rear portion of the seat 122. The recess 132 is partially defined by a concave side surface 134. An opening 136 is defined in the surface that forms the lower portion of the recess 132, and is in communication with the open space beneath the seat 122.

FIG. 20 depicts the toilet training device 120 with an odor remediation insert 138 positioned within the recess 132. The odor remediation insert 138 is preferably identical in size, shape and composition to the odor remediation insert 42 that has previously been described with respect to the first embodiment of the invention.

In order to install the odor remediation insert 138 within the recess 132, a consumer will press the odor remediation insert 138 downwardly into the recess 132 until the outer circumferential surface of the insert 138 is compressed in an interference fit by the concave side surface 134 of the recess 132. In order to remove the odor remediation insert 138 from the recess 132, the consumer will use his or her finger to press upwardly on the odor remediation insert 138 from below, through the opening 136. A raised rim 131 is provided along the outer perimeter of the recess 132 for securing the insert 138 in place.

Figure 21:
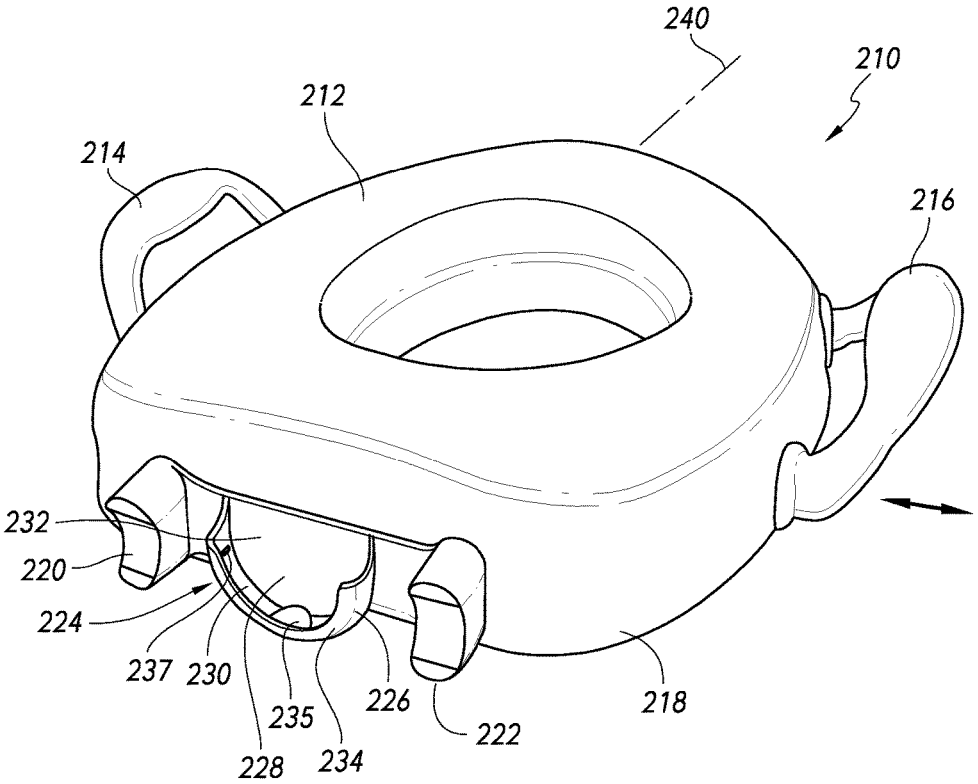
FIG. 21 is a perspective view of a toilet training device that is constructed according to a third embodiment of the invention.
Figure 22:
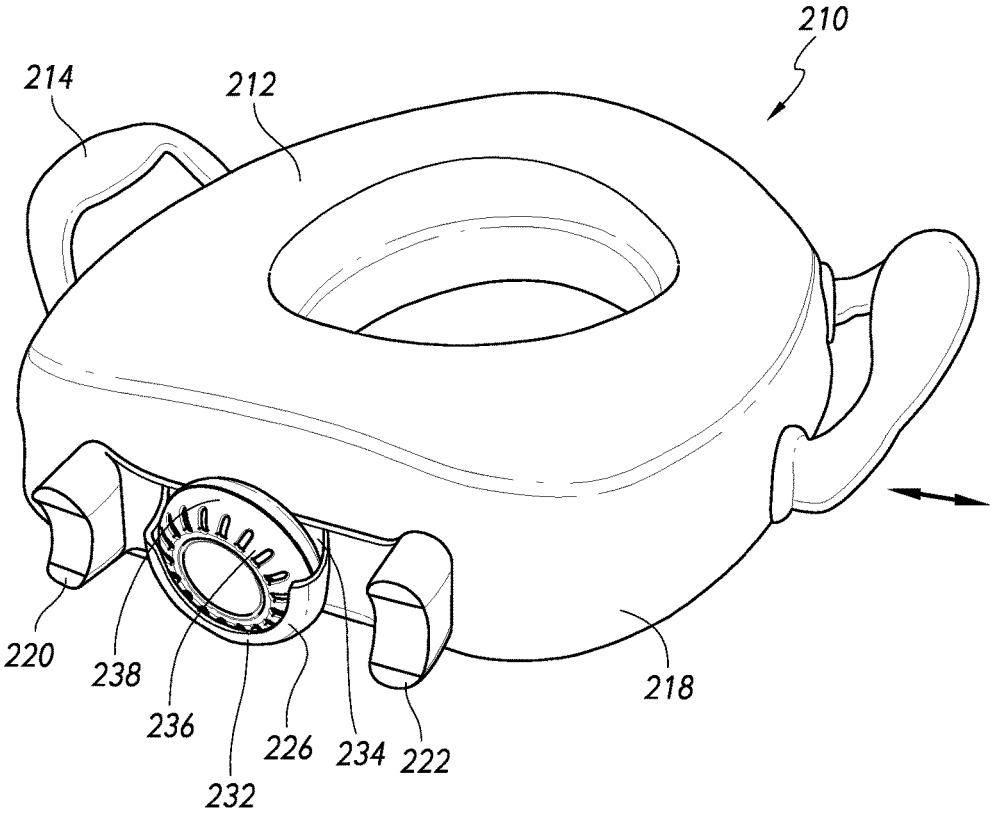
FIG. 22 is a perspective view of the toilet training device shown in FIG. 21, with an odor remediating insert positioned therein.

A toilet training device 210 that is constructed according to a third embodiment of the invention is depicted in FIGS. 21 and 22. Toilet training device 210 preferably includes a soft seat cushion 212 that is mounted to a main body portion 218. A pair of handles 214, 216 is slightly mounted within sockets so as to be selectively extendable from the main body portion 218.

A pair of support feet 220, 222 is preferably mounted to a rear surface of the main body portion 218 for vertical storage when the device 210 is not in use. An odor remediation system 224 includes a mounting bracket 226 that is preferably integral with and spaced apart from the support feet 220, 222. Mounting bracket 226 is preferably fabricated from a substantially rigid plastic material such as polypropylene.

As FIG. 21 shows, the mounting bracket 226 includes an inner recess 228 that is partially defined by a curved inner surface 230, partially defined by a substantially flat rear surface 232 and partially defined by a curved front wall 234. At least one bump or projection 237 is provided on the inner surface 230 for creating an interference fit with the odor remediation insert 236 in order to releasably secure the odor remediation insert 236 within the mounting bracket 226. A finger hole 235 is also defined in a bottom portion of the curved surface 230 in order to help a user eject the odor remediation insert 236 from the bracket 226.

FIG. 22 depicts an odor remediation insert 236 positioned within the mounting bracket 226. Odor remediation insert 236 is preferably substantially identical in size, shape and construction to the odor remediation insert 42 that has been described with respect to the first embodiment.

In order to install the odor remediation insert 236 into the mounting bracket 226, a consumer will press the odor remediation insert 236 downwardly into the mounting bracket 226 so that the curved outer surface 238 conforms to the curved inner surface 230 that is defined within the mounting bracket 226. The odor remediation insert 236 in this position will further be constrained by the rear wall 232 and the front wall 234. To remove the odor remediation insert 236, the consumer will pinch the exposed upper portion of the odor remediation insert 236 with his or her fingers and pull it upwardly out of the mounting bracket 226.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A toilet training device, comprising:

a seat assembly comprising:

a lid; and a seat having a central opening;

a portable main body portion having a shell with an interior space housing a removable waste bin, and adapted to support the seat assembly thereon;

a substantially round blind recess defined in the lid and positioned directly over and in direct communication with the central opening of the seat; and a self-contained odor remediating insert that is completely enclosed and permanently contained by a housing having an upper portion with a plurality of ventilation holes defined therein, and a lower portion permanently attached to the upper portion wherein the lower surface of the housing of the self-contained odor remediating insert is releasably received by an interference fit with raised ribs defined in at least one side wall of the blind recess upon finger-pressing the housing of the self-contained odor remediating insert perpendicularly into the blind recess.

2. A toiled training device according to claim 1, further comprising the odor remediating insert releasably positioned within the recess.

3. A toilet training device according to claim 1, wherein the toilet training device has a longitudinal axis, and wherein the recess is substantially centered with respect to the longitudinal axis.

4. A toilet training device according to claim 2, wherein the odor remediating insert includes an odor absorbing substance.

5. A toilet training device according to claim 4, wherein the odor remediating insert includes an odor masking substance.

6. A toilet training device according to claim 1, wherein the odor remediating insert includes a housing having an upper portion, lower portion, and at least one opening defined therein, the housing completely encapsulating an odor remediating substance.

7. A toilet training device according to claim 1, wherein the recess is defined in an underside of the lid.

8. A toilet training device according to claim 7, Wherein the recess is substantially centered in a rear surface of the main body portion.

9. A toilet training device according to claim 1, wherein the recess includes structure for releasably retaining the odor remediating insert.

10. A toilet training device according to claim 1, wherein the recess includes a finger recess for aiding a user in removing the odor remediating insert.

11. A toilet training device according to claim 2, wherein the odor remediating insert is substantially round.

12. A toilet training device according to claim 6, wherein the odor remediating insert includes a porous pouch disposed between the upper and lower portion of the housing, the porous pouch containing the odor remediating substance and an odor absorbing substance.

13. A toilet training device, comprising:

a portable main body portion having a shell with an interior space housing a removable waste bin;

a seat assembly adapted to be supported by the main body portion;

a substantially round blind recess defined in the seat assembly, the seat assembly comprising:

a lid; and a seat having a central opening, wherein the substantially round blind recess is positioned directly over and in direct communication with the central opening; and a self-contained odor remediating insert having a housing and odor remediating substance, the housing including an upper portion and a lower portion permanently attached to the upper portion which define an enclosed interior space which permanently contains the odor remediating substance, wherein the odor remediating insert is releasably retained by an interference fit between a circumferential outer surface of the housing and raised ribs defined in at least one side wall of the substantially round blind recess upon finger-pressing the housing of the odor remediating insert perpendicularly into the blind recess.

14. A toilet training device according to claim 13, wherein the odor remediating insert includes a porous pouch containing the odor remediating substance, the porous pouch being disposed within the interior space and containing an odor absorbing substance.

15. A toilet training device according to claim 13, wherein the odor remediating insert is releasably attached to a lid that comprises part of the seat assembly.

16. A toilet training device according to claim 15, wherein the odor remediating insert is releasably attached to an underside of the lid.

17. A toilet training device according to claim 15, wherein the odor remediating insert does not substantially protrude with respect to the lid.

* * * * *